United States Patent [19]

Simpson, III

[11] 4,385,584

[45] May 31, 1983

[54] BOAT ANCHOR

[76] Inventor: Lee S. Simpson, III, 4275 N. Chateau Fresno Ave., Fresno, Calif. 93711

[21] Appl. No.: 283,452

[22] Filed: Jul. 15, 1981

[51] Int. Cl.[3] ..... B63B 21/44

[52] U.S. Cl. ..... 114/306; 114/294; 114/301; 114/304

[58] Field of Search ..... 114/294, 297, 298, 301–311

[56] References Cited

U.S. PATENT DOCUMENTS

| | | | |
|---|---|---|---|
| 536,177 | 3/1895 | Baker | 114/307 |
| 602,719 | 4/1898 | Bowers | 114/303 |
| 625,192 | 5/1899 | Norton | 114/303 |
| 653,062 | 7/1900 | Bowers | 114/303 |
| 2,735,395 | 2/1956 | Ballman | 114/303 |
| 2,741,209 | 4/1956 | Reckendorf | 114/307 |
| 2,981,219 | 4/1961 | Winslow | 114/298 |
| 3,306,248 | 2/1967 | Austin | 114/303 |
| 3,332,387 | 7/1967 | Winslow | 114/303 |
| 3,404,652 | 10/1969 | Gardy | 114/297 |
| 3,964,420 | 6/1976 | Stelling | 114/303 |

*Primary Examiner*—Trygve M. Blix
*Assistant Examiner*—C. T. Bartz
*Attorney, Agent, or Firm*—Huebner & Worrel

[57] ABSTRACT

An improved boat anchor assembly including an anchor shank having a pair of penetrating flukes pivotally connected thereto and supported for angular displacement about an axis normally related to the longitudinal axis of the shank, motion limiting stops mounted on the shank for arresting pivotal motion of the flukes relative to the shank, said shank being provided with a pivotal coupling interposed between the ends thereof and a shear pin for imparting stability to the shank and adapted to give way under angularly applied loads of predetermined magnitudes whereby the shank is permitted to "break" for facilitating recovery of the anchor, and releasable coupling means including a single non-load bearing pin for releasably locking said flukes and said shanks into an integral configuration whereby the anchor readily may be disassembled for compact storage.

12 Claims, 10 Drawing Figures

BOAT ANCHOR

BACKGROUND OF THE INVENTION

1. Field of the Invention

The invention generally relates to boat anchors for use in the so-called small boat industry, and more particularly to an anchor which readily may be disassembled for stowage, assembled for use, as well as be readily recovered in the event the flukes thereof penetrate a mud bottom sufficiently to preclude extraction in a usual manner.

2. Description of the Prior Art

As can fully be appreciated by those familiar with the small boat industry, anchors designed for use in mud bottoms often are provided with relatively wide, pointed flukes, pivotally supported by a cross head mounted on a shank, whereby the flukes may penetrate a sand or mud bottom as the anchor is drug thereacross. Often, objects buried in the bottom capture the anchor making extraction in a conventional manner extremely difficult, if not impossible. As a consequence, the loss of an anchor is not an uncommon experience. Also, more than one anchor often is carried on-board a vessel, even though stowage space usually is severely limited.

As a consequence of the aforementioned inadequacies of the prior art anchors, it should now be apparent that there currently exists a need for an improved, lightweight anchor having penetrating flukes which readily can be assembled for use, disassembled for stowage, and in the event the anchors become "stuck", readily extracted from a bottom with an attendant minimal loss of time and effort.

It is therefore the general purpose of the instant invention to provide an improved penetrating anchor of a lightweight design having particular utility in the small boat industry adapted to be disassembled for compact stowage, rapidly assembled for use, and readily extracted from the bottom in the event the anchor becomes inextricably lodged.

OBJECTS AND SUMMARY OF THE INVENTION

It is an object of the instant invention to provide an improved, lightweight, penetrating anchor of an improved design.

It is another object to provide an improved, lightweight, penetrating anchor particularly adapted rapidly to be assembled and disassembled.

It is another object to provide an improved, lightweight, penetrating anchor having a shank adapted to "break" without separation, for facilitating extraction of the flukes thereof from a bottom.

These and other objects and advantages are achieved through the use of an anchor shank having a cross head pivotally supporting a pair of penetrating flukes, motion limiting stops for limiting the pivotal throw of the flukes relative to the shank, a knuckle joint interposed between the ends of the shank, and stabilizing shear pin inserted in the shank adapted to release one end of the shank relative to the other for accommodating pivotal motion therebetween under a predetermined load, and a single non-load bearing pin for releasably interlocking flukes and the shank into an integral configuration.

DESCRIPTION OF THE PREFERRED EMBODIMENT

Figure 1:
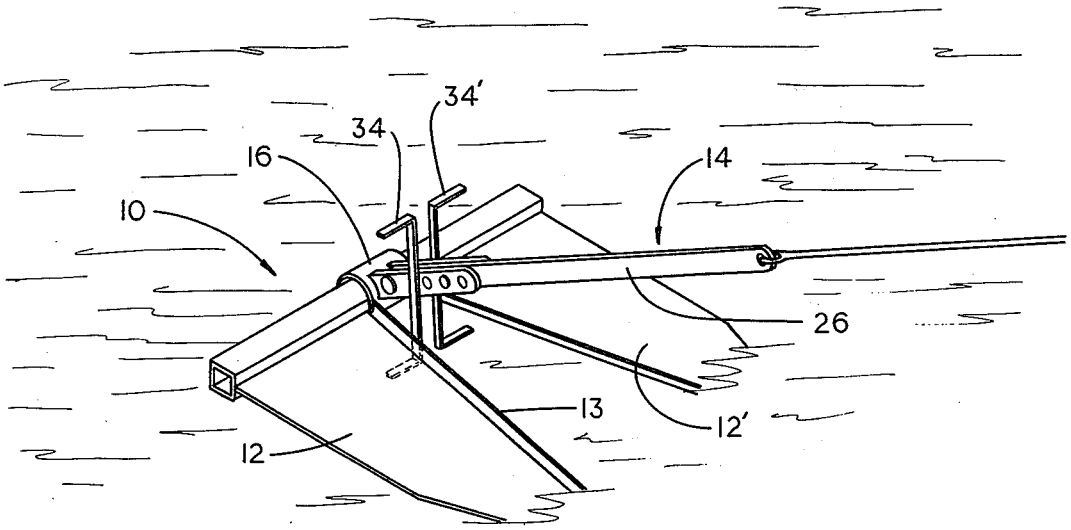
FIG. 1 is a view depicting an operative environment for an anchor embodying the principles of the instant invention.

Referring now to the drawings, with more particularity, wherein like reference characters designate like or corresponding parts throughout the several views, there is shown in FIG. 1 an anchor, generally designated 10, embodying the principles of the instant invention.

Figure 2:
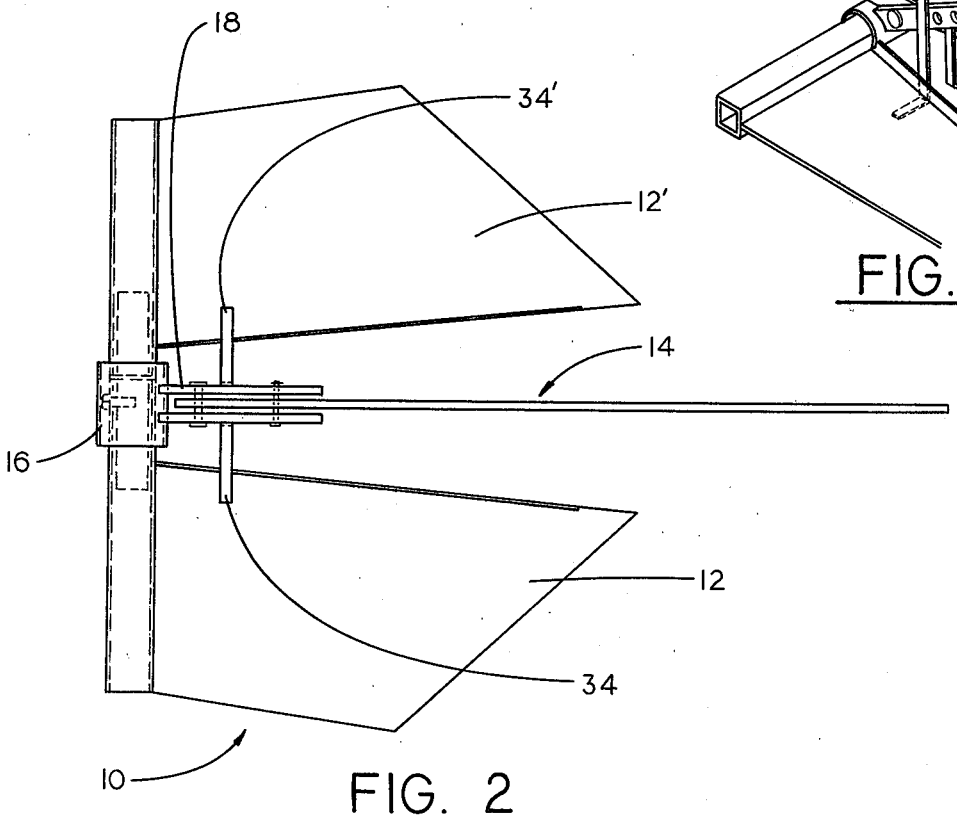
FIG. 2 is a top plan view of the anchor shown in FIG. 1.

The anchor 10, as better shown in FIG. 2, includes a pair of wide, flat flukes, designated 12 and 12', tapered inwardly to a slender point for facilitating a penetration thereof into a sand or mud bottom. The flukes 12 and 12' are attached to a shank 14 through a cross head assembly 16. The cross head assembly 16, FIG. 3, comprises a tubular member or barrel extended transversely and welded to the base end portion 18 of the shank 14.

Along the innermost edge of each of the flukes 12 and 12', there is extended a stiffener 13 which serves to enhance the strength of the fluke without significantly increasing the weight thereof.

Figure 3:
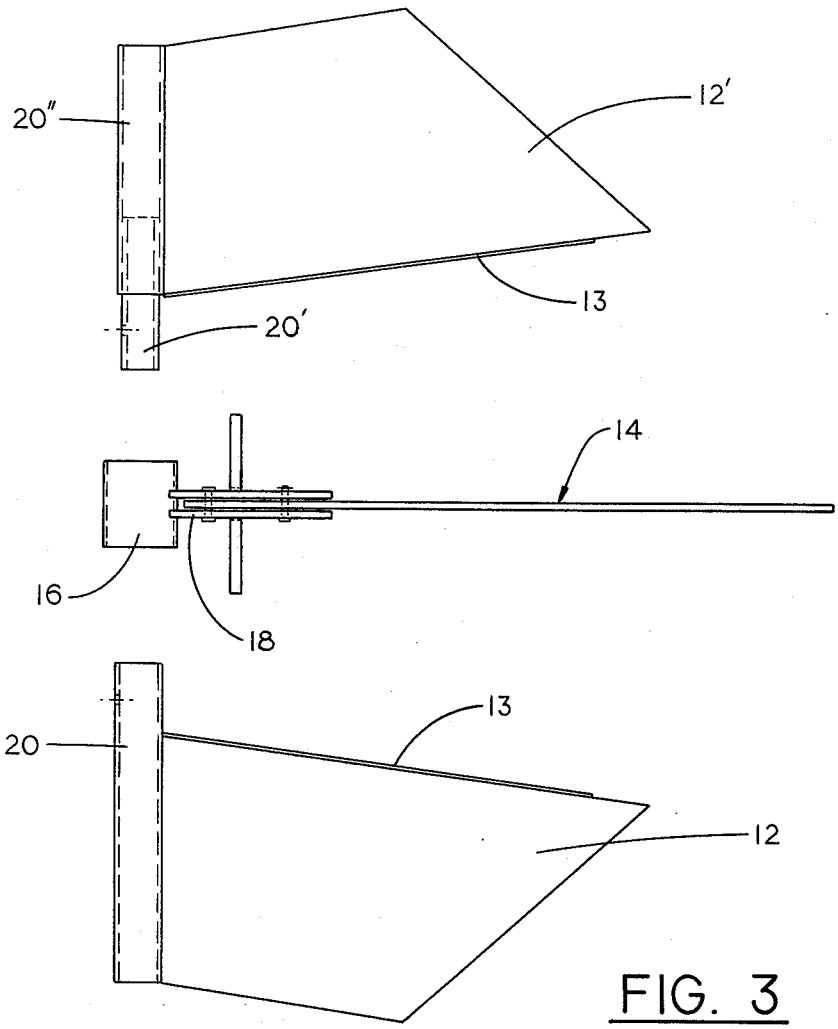
FIG. 3 is an exploded view of the anchor.

The flukes 12 and 12' are provided with transversely oriented, telescopic coupling members, designated 20 and 20', respectively, FIG. 3. It is noted that in practice, the telescopic member 20 comprises a length of box tubing projected beyond the peripheral edge of the inboard side of the fluke 12 sufficiently to be received within the barrel of the cross head 16. The telescopic coupling member 20' also comprises a length of box tubing projected inwardly a distance sufficient to be received within the barrel of the cross head 16. However, the outside dimension of the member 20' is such that it is received in a telescoped relationship with the member 20.

Preferably, the member 20' is mounted on the fluke 12' through the use of a length of box tubing 20'' welded to the fluke 12' and adapted to receive an end portion of the member 20', as shown in FIG. 3. The member 20' preferably is welded in place within the box tubing 20''.

It should now be apparent that simply by inserting the telescopic members 20 and 20' in opposite directions to the barrel of the cross head 16, the flukes are brought into a mutually mated relationship.

Figure 8:
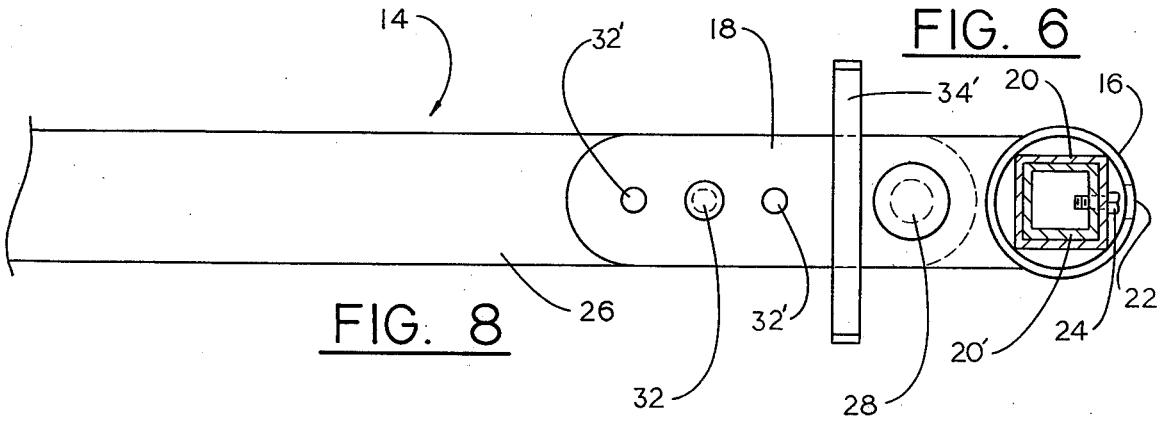
FIG. 8 is a fragmented, cross-sectional view illustrating the relative positioning of a knuckle joint and a shear pin for facilitating a "breaking" of the shank in the presence of excessive angular loading of the shank.

As shown in FIG. 8, the telescopic members 20 and 20' are provided with internally threaded bores, not designated, which are so positioned relative to the members as to facilitate coaxial alignment. While the fastener or pin 24 is shown as a threaded pin, it is to be understood that a "snap-lock" pin or similar fastener could be employed in lieu of the threaded pin, particularly since the pin 24 is considered to be a non-load bearing pin.

Figure 6:
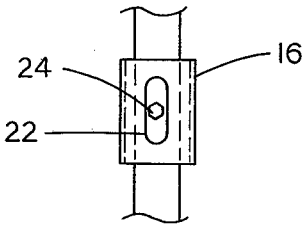
FIG. 6 is a fragmented view of the cross head shown in FIG. 5, depicting the positioning of a non-load bearing fastener used in securing the assembly in an integrated configuration.

As illustrated in FIGS. 6 and 8, the barrel of the cross head 16 is provided with an opening or elongated slot 22 the purpose of which is to accommodate access to the telescopic members 20 and 20' for purposes of inserting a non-load beariing fastener or pin 24.

Moreover, it is believed to be important to note that the barrel of the cross head 16 protects the pin 24 from external access in every position except a position in which the flukes are in coplanar alignment with the shank 14. Hence, there is little likelihood that the pin 24 can be lost from the cross head.

Figure 10:
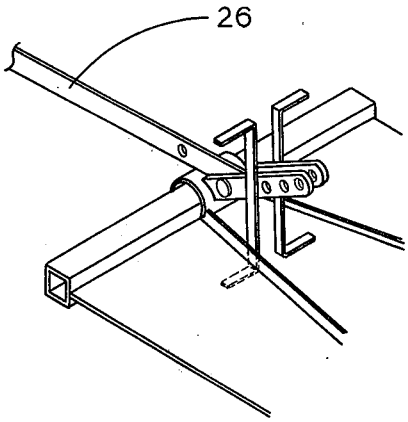
FIG. 10 depicts the shank in a "broken" configuration.
Figure 9:
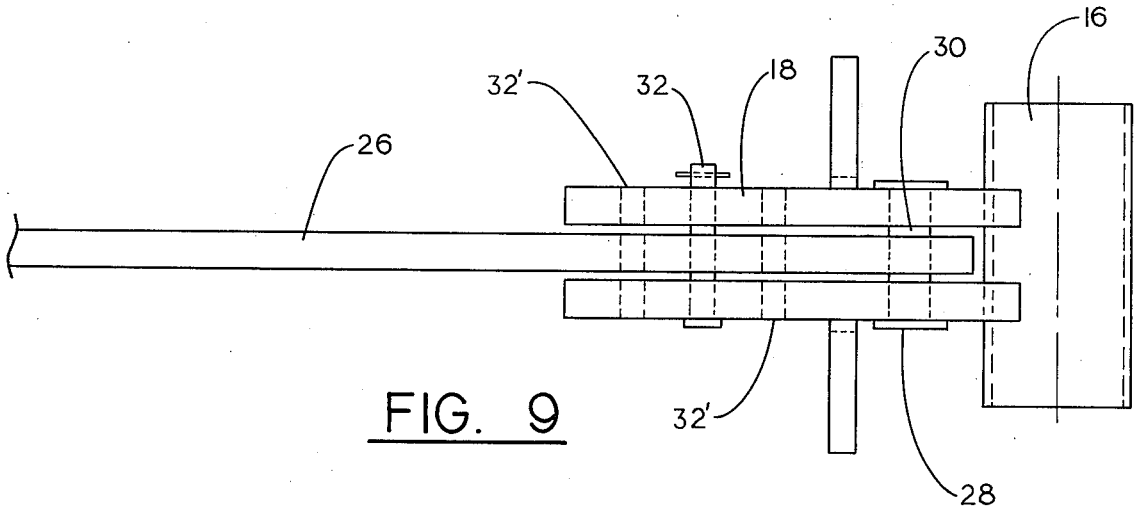
FIG. 9 is a top plan view of the shank and cross head.

Referring now to FIGS. 8 and 9, it can be seen that the base end portion of a shank 14, generally conforms to the shape of a clevis and serves to receive one end of an anchor shaft 26. The anchor shaft 26 is pivotally connected to the base end portion of the shank at a knuckle joint, designated 28. This joint is defined by a load-bearing pin 30 extended through coaxially aligned bores extended transversely through the base end portion 18 and the adjacent end portion of the shaft 26. Thus the shaft 26, unless otherwise stabilized, is free to rotate at one end thereof about the pin 30 of the knuckle joint 28. Consequently, as illustrated in FIG. 10, unless stabilized, the shaft 26 can be rotated into a position substantially paralleling the plane of the flukes 12 and 12' whereby tension applied to the shaft 26, with the shaft 26 in parallelism with the flukes, accommodates the application of an extraction force to the flukes in substantially the plane thereof and reversed to the direction of the force utilized in causing the flukes to penetrate the bottom.

In order to stabilize the shaft 26, in coaxial alignment with the base end portion 18 of the shank 14, there is provided a resistance member or shear pin 32. The shear pin serves to connect the base end portion 18 of the shank 14 to the adjacent end of the shaft 26 at a point spaced from the pin 30. Thus the shaft is stabilized. A plurality of bores 32' extended in parallelism with the pin 30 is arranged in axial alignment along the shank 14. Thus the position of the shear pin 32 is adjustable for accommodating loads angularly applied to the end of the shank 14 via a tensioned anchor line, such as the line shown in FIG. 1. Hence, the magnitude of the load under which the shank is permitted to "break" can be established through calculation, or empirically if so desired.

In order to assure that a load angularly applied to the shank 14 of the anchor is applied directly to the flukes 12 and 12', there is provided motion-arresting stops 34 and 34'. The stops 34 and 34' are of similar design and construction and therefore a detailed description of a single one of the motion-arresting stops is deemed adequate to provide for a complete understanding of the instant invention.

Figure 7:
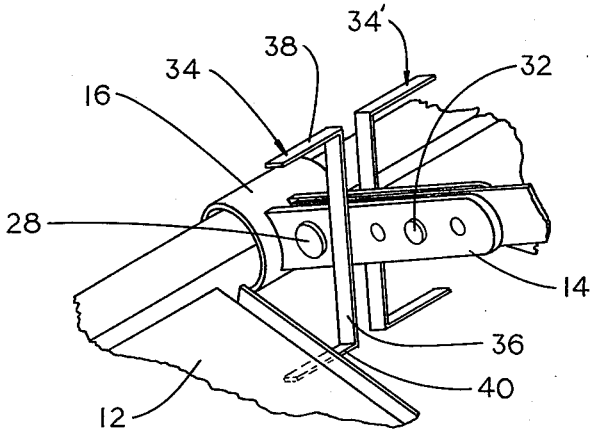
FIG. 7 is a fragmented view depicting motion-arresting stops provided for limiting pivotal motion of the anchor flukes relative to the anchor shank.
Figure 5:
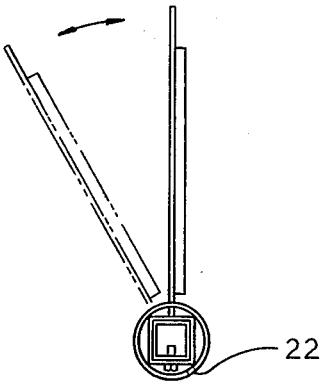
FIG. 5 is a cross-sectional view taken through the anchor's cross head.

As best shown in FIG. 7, the motion-arresting stop 34 is of a generally U-shaped configuration having a base portion 36 welded to the base end portion 18 of the shank 14, and a pair of legs 38 and 40 extended outwardly from the shank 14 to a position at opposite sides of the fluke 12 so as to capture the fluke 12 therebetween and thus limit the throw of its pivotal motion relative to the shank about an axis coincident with the axis of the barrel of the cross head assembly 16. Thus the legs 38 and 40 limit the throw of the flukes relative to the shank, whereby angular loading of the shank via an anchor line is transmitted directly to the flukes of the anchor.

OPERATION

Figure 4:
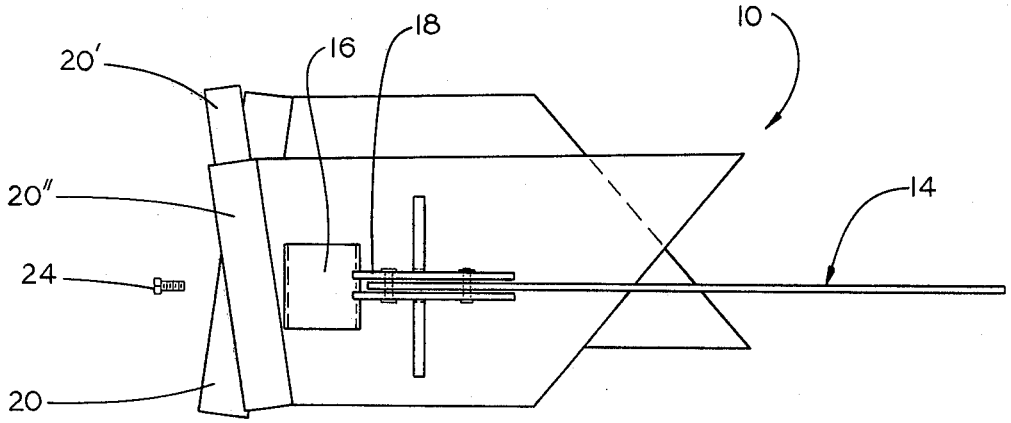
FIG. 4 is a top plan view depicting the anchor of the instant invention in a disassembled and in a stowed configuration.

With the anchor 10 disassembled and stowed in the configuration shown in FIG. 4, it is a simple matter to ready the anchor for operation. To achieve the assembly of the anchor, the telescopic members 20 and 20' are inserted in opposite directions into the barrel of the cross head 16 with the flukes arranged in mutually coplanar relation, and pinned together employing the non-load bearing pin 24. The pin is inserted through the aligned bores formed in the members 20 and 20'. Thus the anchor is readied for use. Where desired, the shear pin 32 is repositioned toward the distal end of the shank 14, where the shank is intended to withstand greater angular loading about the axis passing through the cross head 16. Conversely, where the anchor shank is to "break" under a lesser force angularly applied to the shank via the anchor line, the pin 32 is repositioned nearer the knuckle joint 28.

Once the anchor is "dropped" and drug along the bottom, the flukes 12 and 12' penetrate the bottom and serve to anchor the vessel. In the event the flukes cannot be extracted in a usual manner, sufficient tension is applied to the anchor line for applying an angular force to the shank 14 sufficient to cause the shank 14 to "break" as the shear pin 32 fails. Thus the shaft 26 is permitted to rotate to a reversed position into a plane substantially paralleling the plane of the flukes 12 and whereby tension now applied by the anchor line is applied to the flukes of the anchor in a plane substantially paralleling the plane of the flukes, in a direction opposite to that in which forces were applied in causing the flukes to penetrate the bottom. Consequently, extraction of the flukes is enhanced.

The anchor can, of course, be disassembled in a manner wherein the steps of assembly are reversed and employed in reverse order.

In view of the foregoing, it is believed to be readily apparent that the anchor of the instant invention comprises an improved anchor assembly which serves to solve many of the problems heretofore encountered by those engaged in the small boat industry.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. An improved boat anchor assembly comprising:

A. a pair of penetrating flukes;

B. an anchor shank pivotally related to said flukes;

C. motion limiting means for limiting the pivotal throw of said shank relative to said flukes; and D. releasable coupling means including a single non-load bearing pin for releasably interlocking said flukes and said shank into an integral configuration, said coupling means further including a cross head having a barrel transversely related to one end of said shank and rigidly affixed thereto, a first elongated telescopic member fixed in transverse relation to one end of one of the flukes of the pair of flukes and characterized by a first cross-sectional dimension, and a second elongated telescopic member fixed in transverse relation to one end of the other fluke of the pair, said second elongated telescopic member being characterized by a cross-sectional dimension suitable for being inserted axially into said barrel and for receiving said first telescopic member in telescoped relation, said first and second members being further characterized by flats mated in mutual face-to-face engagement.

2. An anchor assembly as defined in claim 1 wherein said pin extends transversely into said first and second telescopic members in substantial coaxial alignment with said shank.

3. An anchor assembly as defined in claim 2 wherein each of said telescopic members comprises a length of box tubing, said pin is inserted axially into a pair of coaxially aligned bores, each bore being projected transversely through one wall of a telescopic member, and said barrel is provided with an opening aligned with said pair of coaxially aligned bores when said flukes and said shank is arranged in coplanar relation.

4. An anchor assembly as defined in claim 3 wherein said shank includes a pivot joint interposed between the ends thereof and a shear means for releasing one end portion of said shank for pivotal displacement relative to the other end portion thereof in response to angular loading of a preselected magnitude.

5. An anchor assembly as defined in claim 4 wherein said shear means includes a shear pin repositionable along said shank for accommodating loads of differing magnitudes angularly applied to said shank by an anchor line affixed to one end of said shank.

6. In combination with a boat anchor assembly having flukes, the improvement comprising:

A. a shank interposed between the flukes adapted to have attached to one end thereof an anchor line through which a load angularly may be applied to the shank, said shank having a base end portion supported for pivotal displacement through a coplanar relation with said flukes about an axis passing through the adjacent ends of said flukes and a shaft, a load-bearing pin paralleling said axis pivotally connecting the shaft to the base end portion of the shank, and a shear pin extended through said base end portion and said shaft in parallelism with said load-bearing pin supporting said shaft against pivotal displacement relative to the base end portion of the shank adapted to shear under a load of a preselected magnitude angularly applied to the shear pin in response to a load applied to the shank by an anchor line attached thereto for facilitating pivotal displacement of said shaft relative to the base end portion of said shank; and B. means for interconnecting said flukes to the base end portion of said shank at either side of a plane passing through said shank and intercepting the pivotal axis along the length thereof when said shank and said flukes are in coplanar relation.

7. An improvement as defined in claim 6 wherein said shear pin is repositionable along said shank whereby the resistance thereof to shear loads of differing magnitudes is facilitated.

8. An improvement as defined in claim 6 wherein said means for interconnecting said flukes to the base end portion of said shank includes a pair of horizontally oriented, U-shaped motion arresting members affixed to the base end portion of the shank with legs thereof being disposed at the opposite sides of said flukes.

9. An improved boat anchor assembly, comprising:

A. a shank having a base end portion and a shaft projected from the base end portion of the shank adapted to have attached to its distal end an anchor line; and B. a pair of penetrating flukes disposed in a common plane, said shank being pivotally connected to said flukes and supported thereby for limiting pivotal displacement through the plane of the flukes, said shank being characterized by motion-arresting means for arresting motion of said shank relative to said flukes at the limits of throw of the shank relative to the flukes, an elongated shaft and means including a shear pin and a load-bearing pin connecting the shaft of the shank to the base end portion thereof, said shear pin being adapted to give way under transverse loading of a preselected magnitude applied to said shaft by an anchor line attached thereto.

10. An anchor assembly as defined in claim 8 wherein said shear pin is repositionable along said shaft whereby the resistance thereof to loads of different magnitudes applied to said shaft may be varied.

11. An anchor assembly comprising a pair of flukes having portions engageable with each other in an assembled configuration; a fastener engaging said portions releasably to capture the flukes in said assembled configuration; a shank; coupling means for interconnecting the flukes and the shank in the assembled configuration including a tubular member extending about said portions of the flukes in the assembled configuration wherein said flukes are pivotal within the tubular member when in said assembled configuration substantially about a first predetermined axis, said coupling means mounting the shank for pivotal movement about a second predetermined axis substantially parallel to and spaced from the first predetermined axis; and means borne by the anchor assembly for limiting said pivotal movement of the flukes to a predetermined range about the first predetermined axis.

12. The anchor assembly of claim 11 including a resistance member interconnecting said coupling means and the shank at a point spaced from said second axis on the opposite side thereof from the first axis to prevent movement of the shank about the second axis until sufficient force is applied to the shank to cause said resistance member to release the shank for movement about said second axis.

* * * * *